United States Patent [19]

Thatcher et al.

[11] Patent Number: 4,765,354

[45] Date of Patent: Aug. 23, 1988

[54] PAINT ROLLER CLEANER STRUCTURE

[76] Inventors: Stephen J. Thatcher, 2727 W. 1800 South, Logan, Cache County; Dixon L. Allen, 58 N. 300 West, Smithfield, Cache County, both of Utah 84335

[21] Appl. No.: 100,836

[22] Filed: Sep. 25, 1987

[51] Int. Cl.[4] ..... B08B 3/04

[52] U.S. Cl. ..... 134/182

[58] Field of Search ..... 134/117, 138, 149, 182; 68/213

[56] References Cited

U.S. PATENT DOCUMENTS

| | | | |
|---|---|---|---|
| 2,741,857 | 4/1956 | Linatsas | 134/149 X |
| 3,421,527 | 1/1969 | Dettman | 134/182 X |
| 3,577,280 | 5/1971 | George | 134/138 |
| 4,126,484 | 11/1978 | Monteiro | 134/182 X |
| 4,130,124 | 12/1978 | Sherwin | 134/149 X |
| 4,155,230 | 5/1979 | Lacher, Jr. | 68/213 |
| 4,377,175 | 3/1983 | Fritz | 134/138 |
| 4,380,478 | 4/1983 | Cooney | 68/213 X |

*Primary Examiner*—Philip R. Coe

*Attorney, Agent, or Firm*—M. Ralph Shaffer

[57] ABSTRACT

A painter roller cleaner structure wherein such structure is suitable for connection to a water hose or other solvent delivery system, this for the purpose of cleaning the nap of the roller to be cleaned. The structure includes a container having an open end and also a closed end provided with an inlet port. The wall of the container at such open end is provided with a detent slot for receiving the handle of an applicator. Once a roller, mounted on such applicator, is disposed within the container of the device, then the handle of the applicator is locked in place in the detent slot. Thereafter, pressured solvent may be supplied the container to wash the nap of the roller contained therein. A spacer sleeve may be included about the nap of the roller, for undersized rollers, whereby to direct incoming liquid-flow longitudinally and centrally about and through the roller nap. The spacer sleeve is retained in place by the structure illustrated.

15 Claims, 1 Drawing Sheet

PAINT ROLLER CLEANER STRUCTURE

FIELD OF INVENTION

The present invention relates to cleaning equipment for paint rollers and, more particularly, to a new and improved paint roller cleaner structure which is uniquely suited to receiving a paint roller and its applicator, for suitably containing and retaining the same within such structure in a manner such that the nap of the paint roller can be suitably cleaned by a pressurized solvent source coupled to the structure of the invention.

BACKGROUND OF INVENTION AND BRIEF DESCRIPTION OF PRIOR ART

For artisans, professional painters, and do-it-yourself property owners or property managers, there is the ever present problem of keeping up with refurbishing chores in connection with painted or otherwise finished surfaces i.e. walls, ceilings, and so forth, or of simply finishing new walls and the like. The term "paint" in "paint roller" as used herein refers to any type of liquid, be the same an enamel paint, a latex-type paint, stains, and so forth, in other words, any type of liquid that is or can be used by a roller for application of the same to a surface to be finished.

Commonly, paint rollers include an inner tube and an outernap secured to such tube by an appropriate adhesive or by other means. The nap may be a carpet-like material, can be tufted, fibrous, or form any type of outer covering that is suitable to carry and apply paint or other finishing materials, The usual paint applicator includes a revolvable cylinder member or spindle and a handle secured thereto, the revolvable cylinder member being inserted in the inner tube of the paint roller for rotatable advance of the latter over a wall of other surface to be finished.

There are several procedures extant for cleaning the roller once the same has been used; a common step is to remove the paint roller from the applicator and dip the same in a pail of solvent or other cleaning medium, swishing the same about until the nap is essentially free of the paint used. Familiar to householders is the chore of hosing off the paint roller and shaking the same out over an unused yard area; frequently the hand must be used to "twist out" the solvent carrying paint roller so that the same is freed of the paint and allowed to dry. This is a somewhat messy operation and, further more, the roller is not likely to become very clean.

Another approach, of course, is to discard the paint roller and buy a new one. This is expensive, particularly for high-quality rollers with fluffy naps that are used for applying various textures to walls and ceilings.

The task of cleaning paint rollers includes supplying a suitable solvent. Depending upon the type of paint or stain involved, the solvent may be ordinary tap water, or mineral spirits, turpentine, alcohol, lacquer thinner, and so forth. Water, of course, is used as a roll cleaner where water-based latex paints are used and where residues thereof need to be removed from the nap of a roller to be cleaned.

BRIEF DESCRIPTION OF PRESENT INVENTION

The fundamental inventive concept herein resides in the provision of a paint roller receptacle or container, wherein the latter is suitably designed for receiving any onrush of pressured liquid and permitting the same to clean in a satisfactory manner a paint roller disposed within the receptacle. The structure herein includes a container having a peripheral wall, a closed end provided with an inlet port, and also an essentially cylindrical open end suitable for receiving a paint roller as mounted to its applicator. A detent slot is provided the container wall and communicates with the edge of the container defining its open end. Such detent slot receives the handle of the applicator that can be locked in place. Thus, the paint roller need not be preliminarily removed from the applicator in order for the roller to be cleaned; rather, the applicator with the pre-used paint roller is inserted in the container for cleaning purposes.

Once the applicator handle is locked in place, then a source of pressurized solvent may be coupled to the inlet port of the container, and pressurized fluid from the same directed to proceed through the nap of the roller carried by the applicator. In certain contexts, especially where undersized rollers are employed, a spacer sleeve may be incorporated over the roller nap so as to constrain fluid flow longitudinally and circularly through such nap rather than at areas substantially exterior to the nap. The solid disks of the applicator will be suitable for directing fluid flow coming into the container into areas proximate the nearest edge of the nap.

Patent or other literature are not known to the inventors which directly relate to the invention herein.

OBJECTS

Accordingly, a principal object of the present invention is to provide an new and improved paint roller cleaner structure.

A further object is to provide paint roller cleaner structure wherein container thereof is hollow and is designed to receive an applicator carrying a paint roller to be cleaned, this so that the paint roller does not have to be removed preliminarily from the applicator to effect cleaning purposes.

A further object is to provide a paint roller cleaner structure wherein the on-rush of incoming solvent fluid, such as water, may be appropriately directing longitudinally through and about the nap of a roller so that the latter may be suitably cleaned.

An additional object is to provide a paint roller cleaner structure wherein the applicator container thereof is provided with a detent slot, constructed and arranged in a manner to lock the handle of the applicator in place while the applicator and its paint roller are being cleaned within such container.

The features of the present invention which are believed to be novel are set forth with particularity in the appended claims. The present invention, both as to its organization and manner of operations, together with further objects and advantages thereof, may be best understood by reference to the following description, taken in conjunction with the accompanying drawings in which:

DETAILED DESCRIPTION OF PREFERRED EMBODIMENTS

In the present invention the paint roller may be thought of as an inner tube of which an outer paint-applicator layer is affixed, as by an adhesive or other means. This applicator layer comprises a nap, which may be of tufted material, of carpet-like material, of fibrous material, and so on. The term paint as used herein will include any type of coating application be the same an enamel paint, a water-based or latex paint, stains, lacquers, and so forth. The solvent may comprise a water, as for latex paint, and also mineral spirits, turpentine, paint thinner, alcohol, and so forth.

Figure 1:
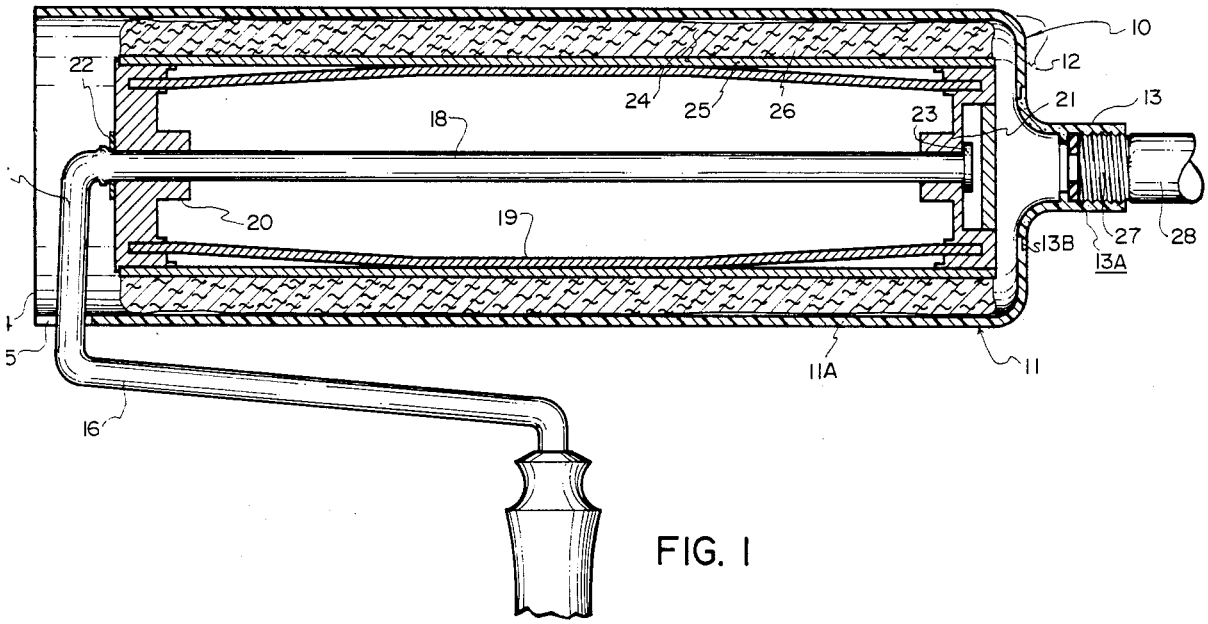
FIG. 1 is a top plan broken away and sectioned for convenience of illustration, of a paint roller cleaner structure, constructed in accordance with the principles of the present invention, and which contains a paint applicator, the paint roller thereof being intended for cleaning purposes within such container.

In FIG. 1 paint roller cleaner structure 10 includes a container 11, with longitudinal axis A, having closed end 12 provided with inlet port 13 also a cylindrical open end 14. Inlet port 13 may comprise a separate part as orifice member 13A, the latter may be provided in a suitable aperture at 13B secured in place by solder, cement, or other means. Of course the container may be molded as an integral one-piece part, this so as to include the inlet port as an integral portion of the container 11 and its wall 11A. L-shaped detent slot 15 is provided the wall of the container and communicates with edge 14 of such container. The purpose for the slot is to receive and lock in place the handle portion 16 of applicator 17. Applicator 17 is conventional in form and includes a shaft 18, provided the bent handle portion 16; a spindle 19 revolvably secured to shaft 18, and end pieces or disks 20 and 21 pivotally receive the shaft and provided with C-rings 22 and 23 locking in appropriate grooves in such shaft exterior the end pieces 20 and 21. Paint roller 24 comprises an inner tube 25 to which is secured a peripheral nap 26 may comprise a tufted material, a carpet-like material, a fibrous coating, and so forth, all being strictly conventional in connection with established art as to paint rollers.

In operation, and as is customary, the paint roller is mounted to the spindle of the applicator and then the user grasps the handle 16, dips and rolls the paint roller in a tray provided with paint, and then applies paint to a wall or other surface. Once the roller is rolled to a semi-dry condition, then the user may use to wash the roller so as to free the same from residual paint or other application material.

In operation relative to the present invention, the applicator and its paint roller are releasably inserted in container 11. The same is retained in place by handle portion 16 of shaft 18 being locked in place, relative to container 11, by the handle portion 16 entering and locking into detent slot 15. Thereafter, the male portion 27 of hose 28, the same being coupled to a pressurized liquid source, will be connected to the inlet port 13 or orifice member 13A as the case may be, so that pressurized solvent fluid, whatever its nature, may be introduced into to container. When such fluid does enter it is deflected by the front end piece or disk 21 so as to be in a position to enter edgewise, the nap 26, proceeding from right to left relative to FIG. 1. The paint particles will thereby become entrained and/or dissolved in the solvent carrier, i.e. water, mineral spirits, turpentine, and so forth, and the fluid will proceed out the left end of the nap to be exhausted through the open end 14 of container 11.

Once sufficient fluid has been run through the nap, then the pressure relative to hose 28 may be turned off, handle portion 16 will be rotationally displaced so as to be withdrawn from detent slot 15, and the applicator with its now-cleaned roller is removed from the container of the structure.

Figure 2:
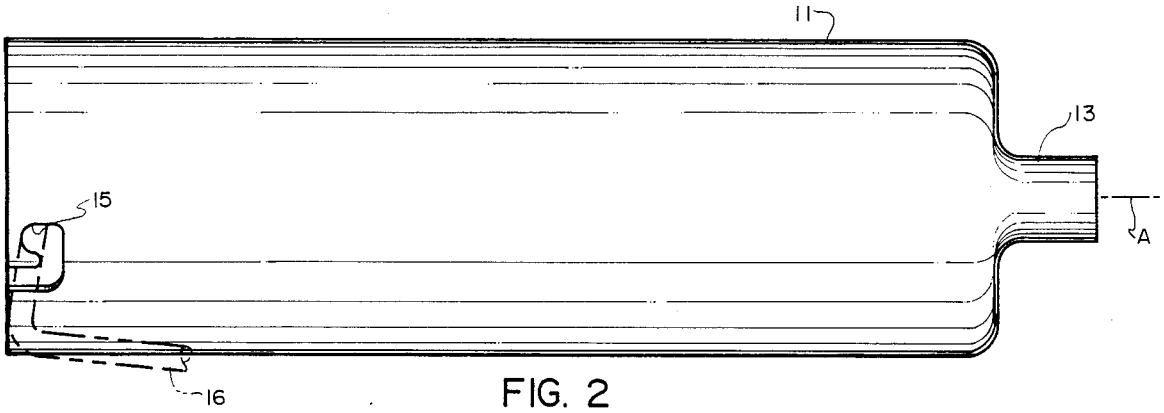
FIG. 2 is similar to FIG. 1 but is non-sectioned and rotated so as to show in dotted line the bent handle of the applicator and to illustrate that such handle is locked in the detent slot provided in the container of the structure.

FIG. 2 is a view of the structure of FIG. 1, slightly rotationally displaced, and illustrates the handle portion 16 as being locked into detent slot 15 relative to container 11.

Figure 3:
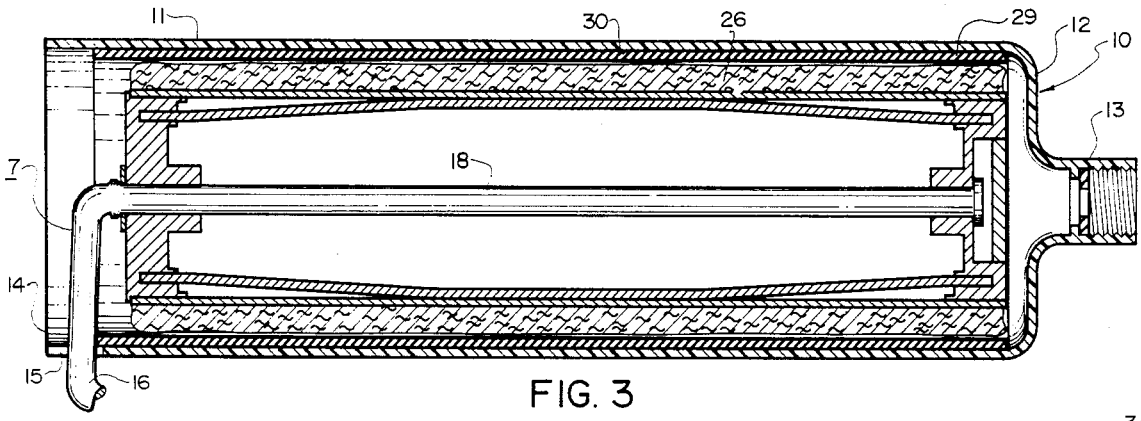
FIG. 3 is similar to FIGS. 1 and 2 but illustrate yet another embodiment of the invention wherein a spacer sleeve is employed to fill up the space between the outer surface of the nap of an undersized paint roller and the inner wall surface of the container of the structure.

FIG. 3 illustrates the structure of the invention as now including a spacer sleeve 29 disposed between the inner wall surface 30 of the container and the outer surface 31 of nap 26. The purpose for the inclusion of the spacer sleeve 29 is to fill up the space as between the outer periphery of the nap and the inner wall surface 30 of container 11. Accordingly, incoming fluid is directed edgewise through the nap from right to left in FIG. 3.

Relative to spacer sleeve 29, a liquid sealing element may be supplied by O-ring 31 mounted over the surface of such sleeve prior to the latter's insertion within container 11. Accordingly, and whether or not the O-ring is inclined to roll along the length of the spacer sleeve, nonetheless the O-ring will supply a further seal for water so as to cause the water or other solvent entering inlet port 13 to proceed edgewise through the nap of the paint roller.

Figure 4:
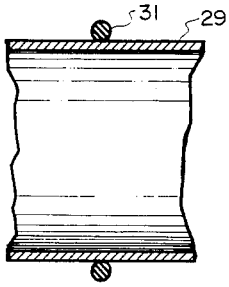
FIG. 4 is a fragmentary side elevation of the space sleeve of FIG. 3 wherein an O-ring is provided the exterior of the spacer sleeve to provide a liquid seal thereabout when the sleeve is inserted in the structure as shown in FIG. 3.
Figure 5:
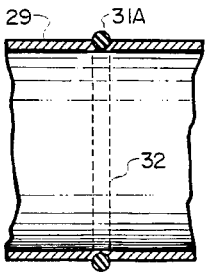
FIG. 5 is similar to FIG. 4 but illustrates that the O-ring used is seated in an exterior peripheral groove provided the spacer sleeve.

FIG. 5 illustrates that the spacer sleeve 29 may include an annular external groove 32 for receiving O-ring 31A similar to O-ring 31 in FIG. 4.

Figure 6:
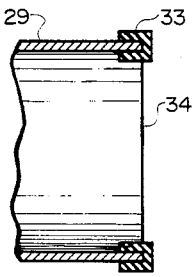
FIG. 6 illustrates the right hand end of the spacer sleeve of the structure wherein such end is provided with an edge sealing ring.
Figure 7:
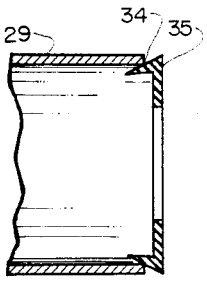
FIG. 7 is similar to FIG. 6 but illustrates that the right hand edge of the spacer sleeve may be urged, through the locking of the applicator handle in the detent slot, into sealing contact with a conical seal provided the close end area of the container of the structure.

In FIG. 6, advantage is taken in the invention of the pressure of the handle 16, in pressing against the left hand surface of the spacer sleeve 29 so as to thrust the right hand edge thereof against the inner wall of the closed end 12 of container 11. In this event it may be advantageous to provide a sealing ring 33 to cover peripherally the right edge 34 of spacer sleeve 29. Such a sealing ring may have a U-shaped elemental transverse cross-section as indicated in FIG. 6.

Rather than the seal of FIG. 6, there may be supplied a conical seal 35 fitted into or disposed against the closed end 12 of container 11 and against which edge 34 of spacer sleeve 29 will be thrust, this by the thrusting action of handle portion 16 against the left edge of the spacer sleeve as shown in FIG. 3.

Accordingly, and relative to FIGS. 3 through 7, whatever form the spacer sleeve 29 and/or its seal may take, the same will be useful in precluding water flow substantially exteriorly of the nap of the paint roller and, rather, will direct a liquid flow edgewise circularly through the nap in a longitudinal direction so that paint removed by the solvent applied can be expelled, with such solvent, out the left end of container 11.

While particular embodiments of the present invention have been shown and described, it will be obvious to those skilled in the art that changes and modifications may be made without departing from this invention is its broader aspects, and, therefore, the aim in the appended claims is to cover all such changes and modifications as fall within the true spirit and scope of this invention.

What is claimed is the following:

1. Paint roller cleaner structure including, in combination, a container with a longitudinal axis and having a closed end and provided with a solvent inlet port and also an open end defining a peripheral edge, said container having a detent locking slot communicating with said edge, said detent locking slot having a locking portion essentially transverse to said axis and being constructed and arranged for locking the handle portion of an external paint applicator provided such handle portion by the mere cooperation of said handle portion with said slot, whereby to clean within said container a paint roller mounted to said applicator.

2. The structure of claim 1 wherein said detent slot is J-shaped.

3. The structure of claim 1 wherein a portion of said slot is longitudinally disposed essentially parallel to said longitudinal axis of said container, the remainder of said slot being hook-shaped and essentially transverse to said longitudinal axis.

4. Paint roller cleaner structure including, in combination, a container having a closed end provided with a solvent inlet port and also an open end defining a peripheral edge, said container having a detent slot communicating with said edge, said detent slot being constructed and arranged for locking the handle portion of an external paint applicator provided such handle portion, whereby to clean within said container a paint roller mounted to said applicator; and spacer sleeve means disposed within and against said container and constructed to contact said paint roller for constraining solvent flow edgewise through said paint roller.

5. The structure of claim 4 wherein said paint roller has a nap, said spacer sleeve means constraining solvent flow through said nap.

6. The structure of claim 4 wherein said spacer sleeve means comprises a spacer sleeve having a peripheral O-ring seal.

7. The structure of claim 4 wherein said spacer sleeve means comprises a spacer sleeve having a medial exterior groove, and an O-ring seal disposed within said groove.

8. The structure of claim 4 wherein said spacer sleeve means comprises a spacer sleeve provided with a forward edge, and a seal secured to and extending about and forwardly of said edge.

9. The structure of claim 4 wherein said container includes an annular seal seat proximate and interior of said closed end and surrounding said inlet port, said spacer sleeve means engaging said seal seat and constructed to be held there-against by said handle portion.

10. The structure of claim 4 wherein said handle portion abuttingly engages said spacer sleeve means for retaining said spacer sleeve means inwardly against said closed end of said container.

11. Paint roller cleaner structure including, in combination, a container having a closed end provided with a solvent inlet port and also an open end defining a peripheral edge, said container having a detent locking slot, which is J-shaped, communicating with said edge; and a paint roller device comprising an applicator having a laterally extending handle portion and a paint roller, having an inner tube and a nap peripherally secured thereabout, mounted over said applicator, said paint roller device being releasably disposed within said container and having said handle portion disposed within and releasably locked in place in and by said detent slot against dislodgement from said container once fluid pressure is applied at said solvent inlet port.

12. The structure of claim 11 wherein said container includes a spacer sleeve dimensioned for abutment with said closed end of said container and retention against said closed end by said handle portion.

13. The structure of claim 12 wherein said spacer sleeve is provided with sealing means for constraining liquid-flow.

14. Paint roller cleaner structure including, in combination, a container having a closed end provided with a solvent inlet port and also an open end defining a peripheral edge, said container having retainer means, comprising a J-shaped slot, proximate and contiguous with said edge; and a paint roller device comprising an applicator having a laterally extending handle portion and a paint roller, having an inner tube and a nap peripherally secured thereabout, mounted over said applicator, said paint roller device being releasably disposed within said container and having said handle portion engaging and being releasably locked in and by said retainer means against dislodgement once fluid pressure is applied to said solvent inlet port.

15. The paint roller cleaner structure including, in combination, a container with an elongate axis and having an open fluid exit end and an opposite fluid inlet port; and a paint roller provided a handle and disposed in said container, said container being provided with a peripheral edge at said open fluid exit end and a detent locking slot, including a locking portion essentially transverse to said container axis, communicating with said edge and receiving and of itself releasably locking said handle to said container against dislodgement once fluid pressure is present at said fluid inlet port, thereby releasably securing said paint roller in said container, for washing purposes.

* * * * *